United States Patent [19]

Fujiwara et al.

[11] 4,321,440

[45] Mar. 23, 1982

[54] CIRCUIT BREAKER WITH EXTENDED CONTACT SEPARATION AFTER TRIP

[75] Inventors: Kouhei Fujiwara; Setsuo Hosogai, both of Fukuyama, Japan

[73] Assignee: Mitsubishi Denki Kabushiki Kaisha, Tokyo, Japan

[21] Appl. No.: 235,369

[22] Filed: Feb. 19, 1981

[30] Foreign Application Priority Data

Feb. 19, 1980 [JP] Japan ..... 55/19865[U]

[51] Int. Cl.[3] ..... H01H 7/16

[52] U.S. Cl. ..... 200/153 G; 200/324

[58] Field of Search ..... 200/153 G, 153 H, 318, 200/323, 324, 325, 288, 327, 321; 74/97

[56] References Cited

U.S. PATENT DOCUMENTS

| | | | |
|---|---|---|---|
| 2,459,629 | 1/1949 | Dorfman et al. | 74/97 |
| 3,134,880 | 5/1964 | Murphy | 200/321 |
| 3,849,751 | 11/1974 | Link et al. | 200/153 G |

FOREIGN PATENT DOCUMENTS

| | | | |
|---|---|---|---|
| 1211639 | 11/1970 | United Kingdom | 200/153 G |
| 1523407 | 8/1978 | United Kingdom | 200/153 G |

*Primary Examiner*—Willis Little

*Attorney, Agent, or Firm*—Robert E. Converse, Jr.

[57] ABSTRACT

A circuit breaker having separable contacts and a releasable trip mechanism operable upon overcurrent conditions to automatically separate the contacts includes a moveable arm stop connected to the releasable mechanism for limiting travel of the moveable contact in the open circuit position. The moveable arm stop includes a cam portion having an extended surface to limit travel of the moveable contact and establish a first contact separation distance when the trip mechanism is latched, and a flat surface limiting travel of the moveable contact to establish a second, greater contact separation distance when the trip mechanism is released.

4 Claims, 4 Drawing Figures

CIRCUIT BREAKER WITH EXTENDED CONTACT SEPARATION AFTER TRIP

BACKGROUND OF THE INVENTION

1. Field of the Invention

The invention relates in general to electrical apparatus and, more particularly, to circuit breakers including means for automatically separating the contacts upon occurrence of an overcurrent condition.

2. Description of the Prior Art

Circuit breakers generally employ a pair of separable contacts connected to an operating mechanism to open and close the contacts in response to manual operation of an operating handle between opened and closed positions. In addition, circuit breakers include means for automatically separating the contacts upon occurrence of an overcurrent condition. This automatic operation is carried out by the of a toggle linkage connected to a movable contact arm, a latched cradle, and an operating spring. Upon occurrence of an overcurrent condition, a latch is operated to release the cradle and cause the line of action of the operating spring to move such as to produce a collapse of the toggle linkage. The contact arm is then rotated by the operating spring until restrained by a fixed arm stop. Contact separation and circuit interruption are thereby produced.

In a circuit breaker constructed in this manner, the distance of maximum contact separation determines the breaker performance, according to such criteria as maximum interrupting capacity and voltage rating. In order to increase the operating performance, the maximum contact separation must also be increased by changing the position of the arm stop. This, in turn, requires an increase in the strength of the operating spring or an increase in the arc of operation of the handle. These modifications are often not practical, due to size constraints of the breaker housing. It would, therefore, be desirable to provide a circuit breaker having an increased contact separation distance during automatic interruption without the necessity for increasing the operating spring force or the required operating arc of the operating handle.

SUMMARY OF THE INVENTION

In accordance with the principles of the present invention there is provided a circuit interrupter including separable contacts having a fixed contact and a movable contact mounted on a movable contact arm. The circuit breaker also includes an operating mechanism having a toggle linkage comprising an upper toggle link and a lower toggle link. The lower link is pivotally connected to the movable contact arm and the upper link is pivotally connected to a cradle. A movable arm stop provided with a cam portion is connected to the cradle. The cam portion has a flat surface and an elongated surface. The cradle is pivoted at one end to the breaker frame and at the other end is engaged by a latch mechanism. An operating handle is provided to operate the circuit between open and closed positions and includes an operating spring connected between the handle and the toggle linkage. Movement of the handle to the closed position with the cradle engaged by the latch mechanism is operable to erect the toggle linkage and rotate the movable contact arm to close the fixed and movable contacts. Correspondingly, movement of the operating handle to the open position with the cradle latched causes the line of action of the operating spring to move past the knee pivot of the toggle linkage and collapse the linkage, causing the movable contact arm to rotate. When the contact arm is rotated to the open position with the cradle latched, the contact arm comes to rest against the elongated portion of the cam surface, to produce a first contact separation distance.

Upon occurrence of an overcurrent condition, the latch mechanism releases the cradle, causing it to rotate under the influence of the operating spring. This moves the toggle linkage knee pivot past the line of action of the operating spring causing collapse of the toggle linkage. Furthermore, it varies the position of the arm stop in relation to the contact arm. Collapse of the toggle linkage is also operable to rotate the movable contact arm and separate the contacts. The movable contact arm then comes to rest against the flat portion of the arm stop cam surface, resulting in a second contact separation distance greater than the first contact separation distance.

The invention, therefore, provides a circuit breaker having improved performance by providing for the contact separation distance to be greater as a result of automatic operation due to overcurrent conditions than the contact separation distance produced under normal opening operation.

DESCRIPTION OF THE PREFERRED EMBODIMENT

Figure 1:
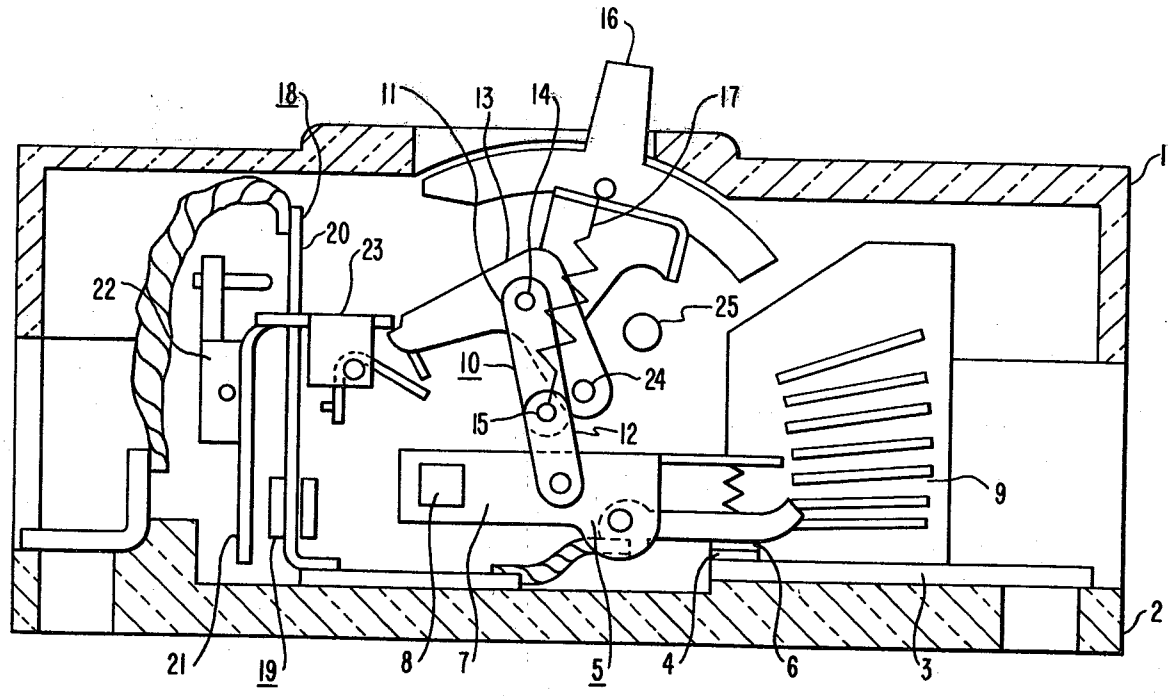
FIG. 1 PRIOR ART
FIG. 1 is a side sectional view of a prior art circuit breaker.

Referring now to the drawings, in which corresponding reference characters refer to corresponding components, FIG. 1 shows a prior art multi-pole circuit breaker with the contacts shown in the closed position. The breaker of FIG. 1 includes a cover 1, a base 2, and a fixed conductor 3, one end of which has a fixed contact 4 and the other end of which is a terminal for connection to an external conductor (not shown). A movable contact means 5 includes a movable contact 6 which opposes a fixed contact 4. The movable contact means 5 also includes a movable contact arm 7 fixedly connected to a crossbar 8 which connects the multiple poles of the circuit breaker such that all poles are open or closed simultaneously. An arc extinguishing chamber 9 is also provided, as is a toggle linkage mechanism 10 constructed of an upper toggle link 11 and a lower toggle link 12. One end of the upper link 11 is pivotally connected to a cradle 13 by a shaft 14, while the other end of the upper link 11 is pivotally connected to one end of the lower link 12 by a knee pin 15. The other end of the lower link 12 is pivotally connected to the movable contact arm 7 of the movable contact means 5. A conventional reciprocating operating handle 16 is provided as is an operating spring 17 connected under tension between the knee pin 15 of the toggle linkage mechanism 10 and the operating handle 16. A thermal trip device 18 and electromagnetic trip device 19 are arranged such that activation of either trip device 18 or 19 will operate either a bimetal strip 20 or a movable iron core, respectively, to rotate a trip bar 22 in a counterclockwise direction. The trip bar 20 is engaged by a latch 23, the other end of which engages the cradle 13. When the operating handle 16 is thrown into the closed circuit position while the cradle 13 is engaged by the latch 23, the toggle linkage mechanism 10 is erected causing clockwise rotation of the movable contact means 5 to engage the movable contact 6 with the fixed contact 4.

If the operating handle 16 is thrown to the open circuit position (downward in FIG. 1) the line of action of the operating spring 17 is moved below the toggle linkage mechanism 10 to cause collapse of the toggle linkage mechanism 10, counterclockwise rotation of the movable contact means 5, and separation of the movable contact 6 from the fixed contact 4. The movable contact arm 7 comes to rest against the shaft 24 to establish the contact separation distance.

If an overcurrent condition should occur with the circuit breaker in the closed circuit condition as shown in FIG. 1, the thermal trip device 18 or electromagnetic trip device 19 will operate to disengage the latch 23 from the cradle 13. The cradle 13 will thus be released to rotate in a clockwise direction about the shaft 24, coming to rest against a cradle stop 25. This rotation of the cradle 13 moves the toggle linkage 10 past the line of action of the operating spring 17, causing collapse of the toggle linkage 10. This causes counterclockwise rotation of the movable contact means 5 and crossbar 8 to separate the movable contacts 6 of each pole from the fixed contacts 4.

If it is desired to increase the performance of the breaker, the contact separation distance with the breaker in the open circuit position must be increased. However, in order to increase this distance the contact arm stop (shaft 24) must be moved up relative to FIG. 1. Correspondingly, either the tension force of the operating spring 17 must be increased, or the arc of operation of the operating handle 16 must be increased. With certain types of breakers, neither of these measures may be practical, due to the constraints of space.

Figure 2:
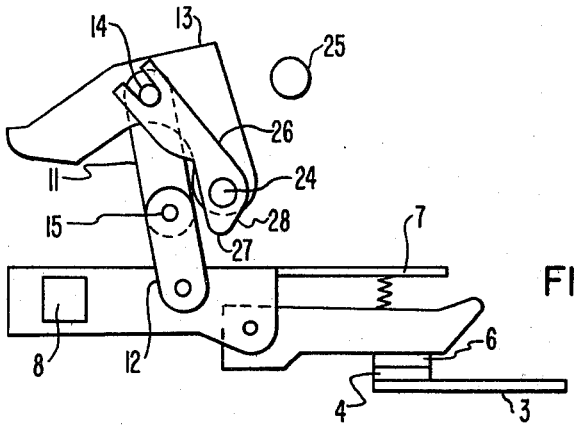
FIG. 2 is a detail side sectional view of a portion of a circuit breaker constructed according to the principles of the present invention, with the contacts in a closed position and the cradle shown in a latched position.
Figure 3:
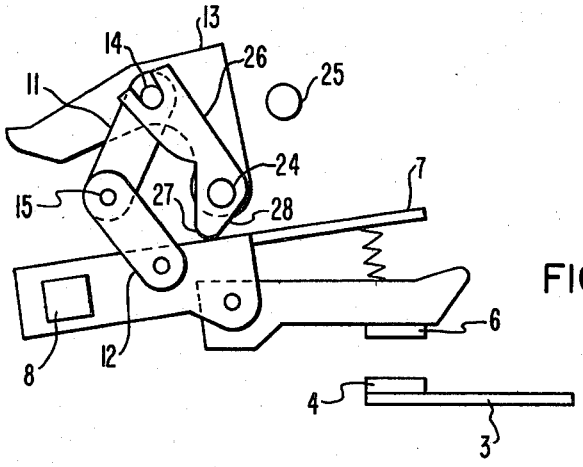
FIG. 3 is a view similar to FIG. 2, with the contacts shown in the open position.
Figure 4:
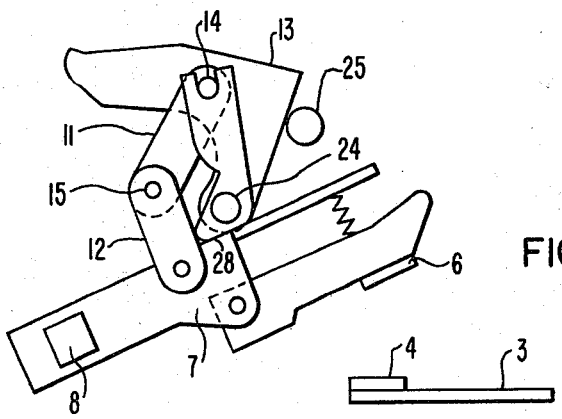
FIG. 4 is a view similar to FIGS. 2 and 3, with the contacts shown in the open position and the cradle in an unlatched position.

The present invention provides a means for lengthening the contact separation distance under automatic operation without increasing the operating spring force requirements or the arc of handle operation. This is accomplished by providing an arm stop link 26 as shown in FIGS. 2 through 4. The link 26 is connected to the cradle 13 at one end to the shaft 24 and at the other end to the shaft 14. The link 26 thus rotates about the shaft 24 as a unit with the cradle 13. The shaft 24 has been moved up in the drawings. All other components of the invention are in common with the prior art device shown in FIG. 1, and thus bear the same reference characters.

The link 26 is arranged such that one end is formed in the shape of a cam having a protruding surface 27 and a flat portion 28. As shown in FIG. 2, the straight line extension of the upper link 11 and lower link 12 of the toggle linkage mechanism 10 in the closed circuit state is not obstructed, and thus the fixed contact and movable contact engage. On the other hand, as shown in FIG. 3, in the open circuit position produced by normal operation of the handle 16, the movable arm 7 engages the protruding portion 27 of the link 26 such that the upper link 11 and the lower link 12 are arranged in a collapsed position at a specified angle to establish a relatively small contact separation distance.

As seen in FIG. 4, an overcurrent condition through the circuit breaker in a closed circuit position will cause the latch 23 to disengage the cradle 13, allowing the cradle 13 to rotate in the clockwise direction, in the same manner as the prior art device, to a resting position with the cradle 13 against the cradle stop 25. Since the link 26 rotates as a unit with the cradle 13, no longer does the extended portion 27 of the link 26 act as contact arm stop for the movable contact arm 7. Rather, the arm 7 continues in counterclockwise rotation about the bar 8 to the position shown in FIG. 4, such that the arm 7 rests against the flat portion of the link 26. The contact separation distance between the fixed contact 4 and the movable contact 6 is thus longer in the tripped open circuit condition than in the normal open circuit condition, and can thus interrupt large currents. It can be seen, therefore, that a circuit breaker constructed according to the principles of the present invention includes a contact arm stop which varies its position according to the rotation of the cradle such that the position of the contact arm stop under normal conditions is different from its position as a result of a tripping operation, thereby producing a larger contact separation distance and making possible greater interruption capacity.

We claim:

1. A circuit breaker, comprising:

a fixed contact;

movable contact means;

a movable contact supported upon said movable contact means;

an operating handle;

a rotatable cradle movable between latched and tripped position;

releasable latch means for latching said cradle in the latched position and operable upon overcurrent conditions to release said cradle;

a toggle linkage connected between said cradle and said movable contact means and operable between extended and collapsed position to move said movable contact means between open and closed positions;

an operating spring connected between said handle and said toggle linkage for extending and collapsing said toggle linkage in response to operation of said handle; and arm stop means having a flat portion and an extended portion for limiting travel of said movable contact means when said circuit breaker is operated to the open circuit position, said arm stop means being connected to said cradle and contacting said movable contact means with said extended portion when said cradle is in the latched position, and contacting said movable arm means with said flat portion when said cradle is in the released position; whereby the contact separation distance is greater when said circuit breaker is in the open position due to an overcurrent condition than when due to a handle operation.

2. A circuit breaker, comprising:

separable contacts;

contact support means operable between open and closed positions for supporting said contacts;

a releasable operating mechanism connected to said contact support means and releasable from a latched to a tripped position in response to an overcurrent condition;

operating handle means connected to said mechanism for operating said contact support means between open and closed positions when said mechanism is in the latched position; and stop means connected to said operating mechanism for limiting travel of said contact support means in the open position to establish a contact separation distance; said stop means comprising an extended portion for engaging said support means when said mechanism is in the latched position and a flat portion for engaging said support means when said mechanism is in the released position;

whereby said contact separation distance is greater when said operating mechanism is in the released position than when said operating mechanism is in the latched position.

3. A circuit breaker as recited in claim 2 wherein said operating mechanism comprises a rotating cradle connected to said contact support means and releasable from a latched to a tripped position, and wherein said stop means comprises an arm stop link connected to said cradle and rotatable as a unit therewith.

4. A circuit breaker as recited in claim 3 wherein said separable contacts comprise a fixed and a moveable contact, and wherein said contact support means comprises a moveable contact arm supporting said moveable contact.

* * * * *